United States Patent [19]

Knoos et al.

[11] 3,983,831

[45] Oct. 5, 1976

[54] BOAT STEERING DEVICE UTILIZING HYDRODYNAMIC SERVO

[75] Inventors: Stellan P. Knoos, Malibu, Calif.; Bertil Ingemar Bostrom, Taby, Sweden

[73] Assignee: Stellan P. Knoos, Malibu, Calif.

[22] Filed: June 17, 1975

[21] Appl. No.: 587,722

[52] U.S. Cl. ..... 114/144 C

[51] Int. Cl.[2] ..... B63H 25/06

[58] Field of Search ..... 114/144 C, 39, 144 R; 46/93

[56] References Cited

UNITED STATES PATENTS

| | | | |
|---|---|---|---|
| 2,653,563 | 9/1953 | Long | 114/39 |
| 3,180,298 | 4/1965 | Gianoli | 114/144 C X |
| 3,765,361 | 10/1973 | Saye | 114/144 C |

*Primary Examiner*—Trygve M. Blix
*Assistant Examiner*—Gregory W. O'Connor
*Attorney, Agent, or Firm*—Edward A. Sokolski

[57] ABSTRACT

A steering device which is particularly suitable for the automatic steering of a sailboat on a preselected heading relative to the apparent wind incorporates a hydrodynamic servo device. An oar member which forms the hydrodynamic servo is mounted in a support housing and positioned in the water behind the boat for both rotational and pendulous motion. Also mounted in the support housing and positioned in the water behind the boat for solely rotational motion is a rudder member which is coupled to the oar member to provide a rotational input thereto in response to steering control signals. These steering control signals may be provided by a dual axis wind vane which generates an output when the heading of a sailboat relative to the apparent wind changes. When the oar member is rotatably driven from its neutral position (i.e., the position where the sidewise hydrodynamic forces balance each other out), the water force pendulously drives this member substantially sidewise. This sidewise motion signal is converted to a rotational motion signal which is coupled to the rudder member to effect steering of the boat in accordance with the steering control signal (in the case of automatic steering, to maintain the desired heading). The rudder-oar member control linkage and wind vane (if used) are integrated with the housing to form a single compact portable unit that can be removably installed on the transom of a boat.

29 Claims, 11 Drawing Figures

FIG. 10
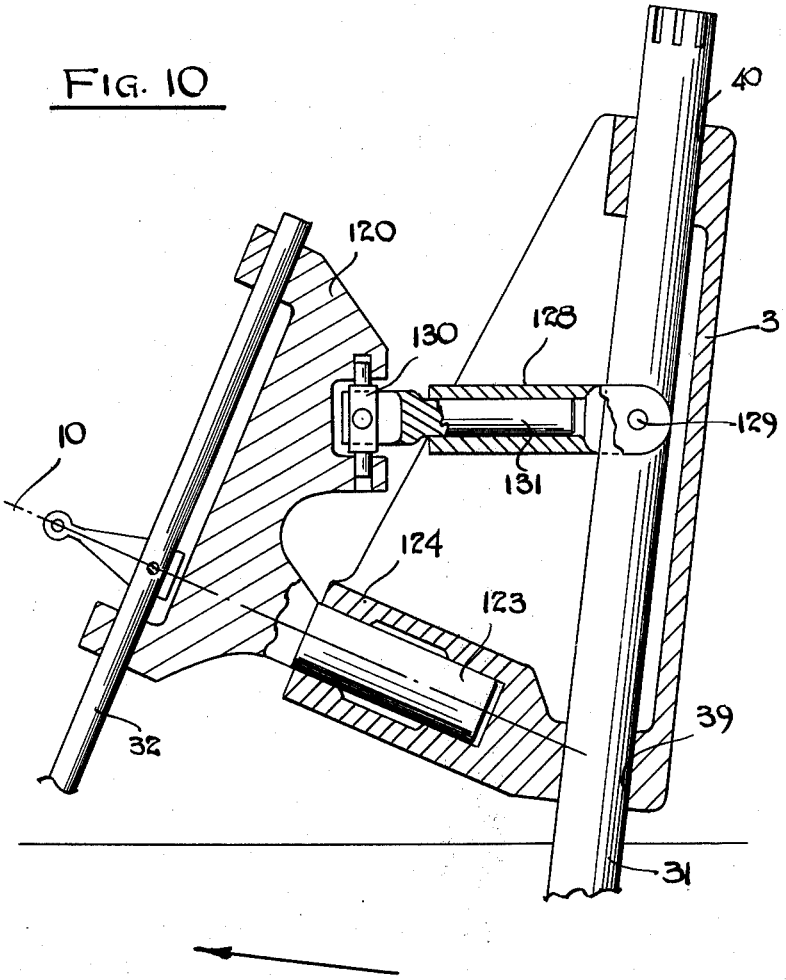
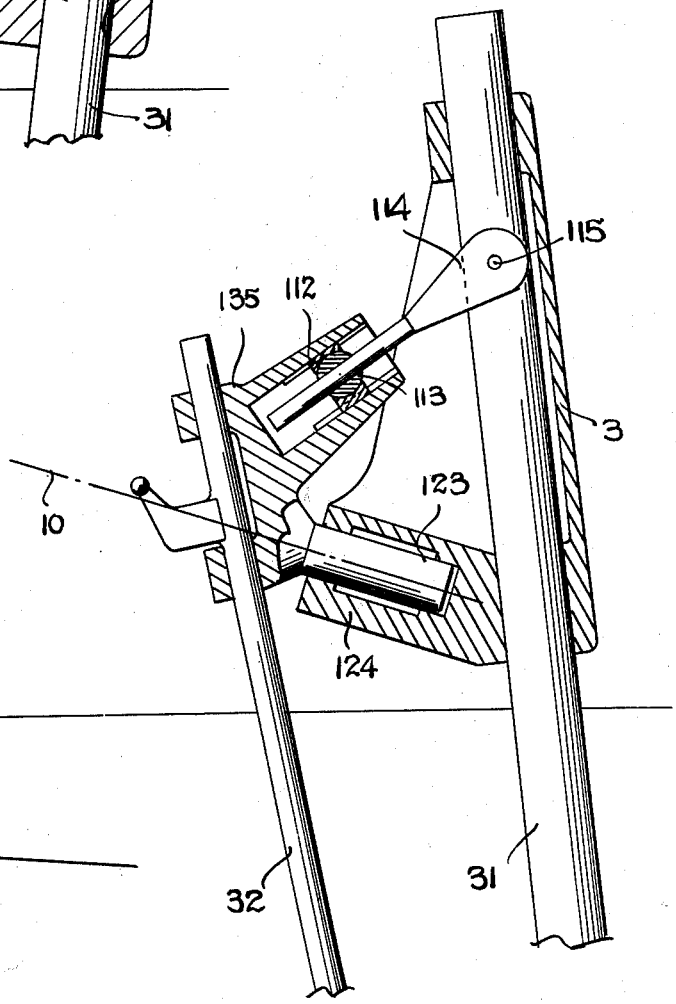
FIG. 11

BOAT STEERING DEVICE UTILIZING HYDRODYNAMIC SERVO

This invention relates to boat steering devices and more particularly to such a device which utilizes an hydraulic servo formed by a rotatably and pendulously supported oar member which is suspended in the water stream.

Automatic steering systems for sailboats are generally either of the electronic type incorporating autopilots and the like, or involve wind vane devices which hold the course of the boat on a predetermined heading relative to the apparent wind. Various types of these devices are thoroughly discussed in a book entitled SELF STEERING FOR SAILING CRAFT by John S. Letcher, Jr., published in 1974 by International Marine Publishing Company, Camden, Maine. Electronic devices have the disadvantage for sailboat use in their dependency on electrical power which is not always available in any great measure in smaller sailing vessels. Further, electronic devices do present a maintenance and reliability problem as compared with most purely mechanical devices. Further, in the case of autopilots which operate to hold the vessel to a compass course and are not responsive to wind shifts, accidental jibe getting in irons and other difficult sailing situations can arise.

Among the various devices of the prior art which operate in response to a wind vane to hold the boat to a selected heading relative to apparent wind direction are systems in which the output of the wind vane is used to directly drive either the regular boat rudder or an auxiliary rudder, and systems in which the output of the wind vane is used to drive an oar member which operates as an hydraulic servo for providing power to drive either the regular rudder or an auxiliary rudder.

Let us first consider systems in which the wind energy alone is used to develop the rudder driving force. Such systems are described, for example, in U.S. Pat. No. 3,319,594 to Gianoli, issued May 16, 1967, as well as the aforementioned book by Letcher. The main disadvantage in systems of this type is that they are incapable of generating sufficient force to properly drive the rudder under all types of sailing conditions, particularly in larger sailboats (8 meters or longer).

Several types of devices which utilize an hydrodynamic servo mechanism to increase the power output of the wind vane are known. These include systems which employ a servo tab attached either to the main rudder or an auxiliary rudder, with the tab either being a hinged part of the rudder or a separate unit behind the rudder. The tab operates to provide a water force directly on the rudder which controls the steering of the rudder. This type of device generally is not capable of developing sufficient power for us in larger boats.

Another type of wind vane device which utilizes a hydrodynamic servo which has found particular favor for use in larger boats, employs an oar member which is placed in the water stream behind the boat and supported for both rotational and pendulous motion. When the oar member is rotatably driven by the wind vane control signal, the water stream operates to drive the member pendulously, in a sidewise direction, the sidewise motion providing a drive for the main rudder of the boat which is coupled thereto by means of a cable linkage. Such a system has been developed by H. G. Hasler and is described in the aforementioned book by Letcher. This device has the drawback in that it requires a somewhat cumbersome rudder coupling mechanism which involves a special installation. Further, it is not portable in nature, nor is it suitable for rapid installation and removal as would be desired where operation either with or without the device is contemplated. Further, with this type of system where the regular rudder is driven by the hydrodynamic servo, a sensitive and compact steering device cannot be employed. This is due to the fact that the ordinary sailboat rudder is not usually sufficiently balanced, i.e., the distance between the rotational axis of the rudder and the center of the hydrodynamic forces operating on the rudder is relatively large, making for a relatively high steering torque. For this reason, a separate and preferably smaller auxiliary rudder, where special attention can be given to the balancing problem, is to be preferred for use in conjunction with a hydrodynamic servo device.

The device of the present invention overcomes the aforementioned shortcomings of the prior art in providing a simple compact device employing a hydrodynamic servo which can be removably installed on the stern of a boat. All of the operating mechanism is integrated into a single unit which incorporates its own rudder for steering the boat, which may be auxiliary to the boat's main rudder or may be the sole rudder. The device, while capable of generating high steering forces, is nonetheless compact and lightweight in construction. The device of the invention is capable of operating in response to a low power wind vane output as well as mechanical signals which could be generated either electrically or manually.

Briefly described, the device of the invention is as follows: Mounted in a support housing for rotational motion about a first axis and pendulous motion about a second axis generally transverse to the first mentioned axis, is an oar member having opposite sides forming hydrodynamic surfaces, which functions as a hydrodynamic servo. The housing is mounted on the transom of a boat with the oar member in the water stream behind the boat. This second oar pendulum axis is tilted downardly with respect to the horizontal plane of the boat in the direction towards the boat transom. A rudder member is mounted in the housing with its blade portion in the water for rotational motion about a single axis, this rudder member being preferably located on the portion of the housing inboard of the oar member when in the installed position. Means are provided in the housing to couple the oar member to the rudder member such that pendulous motion of the oar member will cause rotational motion of the rudder member; the pendulous motion of the oar member being locked to the rotational motion of the rudder member. Means are further provided to couple a steering control signal to the oar member such as to cause rotational motion of the oar member in response to this signal. This control signal may be generated by a wind vane mounted on the housing. With a rotational input to the oar member from the wind vane or other control source, the angle of attack of this oar is changed from a predetermined neutral position, resulting in a hydrodynamic sidewise force on this oar member. This results in pendulous motion of the oar, this motion being transferred through the coupling in the housing to the rudder member to cause rotational movement thereof. The rudder is rotated in a manner such as to steer the boat in response to the control signal (in the case of the wind vane so as to eliminate the steering "error").

In the preferred embodiment, the pendulum oar member is mounted in the housing on two spherical bearings. One of these bearings is mounted on the housing frame, the shaft of the oar member being supported on this bearing for rotational motion about three mutually orthogonal axes. The second spherical bearing is located within the housing away from the frame thereof, and is used in conjunction with a linkage arm to link the oar member shaft to the rudder shaft such that pendulous motion of the oar member shaft results in rotational motion of the rudder shaft with the oar member's pendulum motion being locked to the rudder's rotational motion.

Referring to the drawings,

FIG. 10 is a cross sectional view of still another embodiment of the coupling mechanism; and FIG. 11 is a cross sectional view of still a further embodiment of the coupling mechanism.

Figure 1:
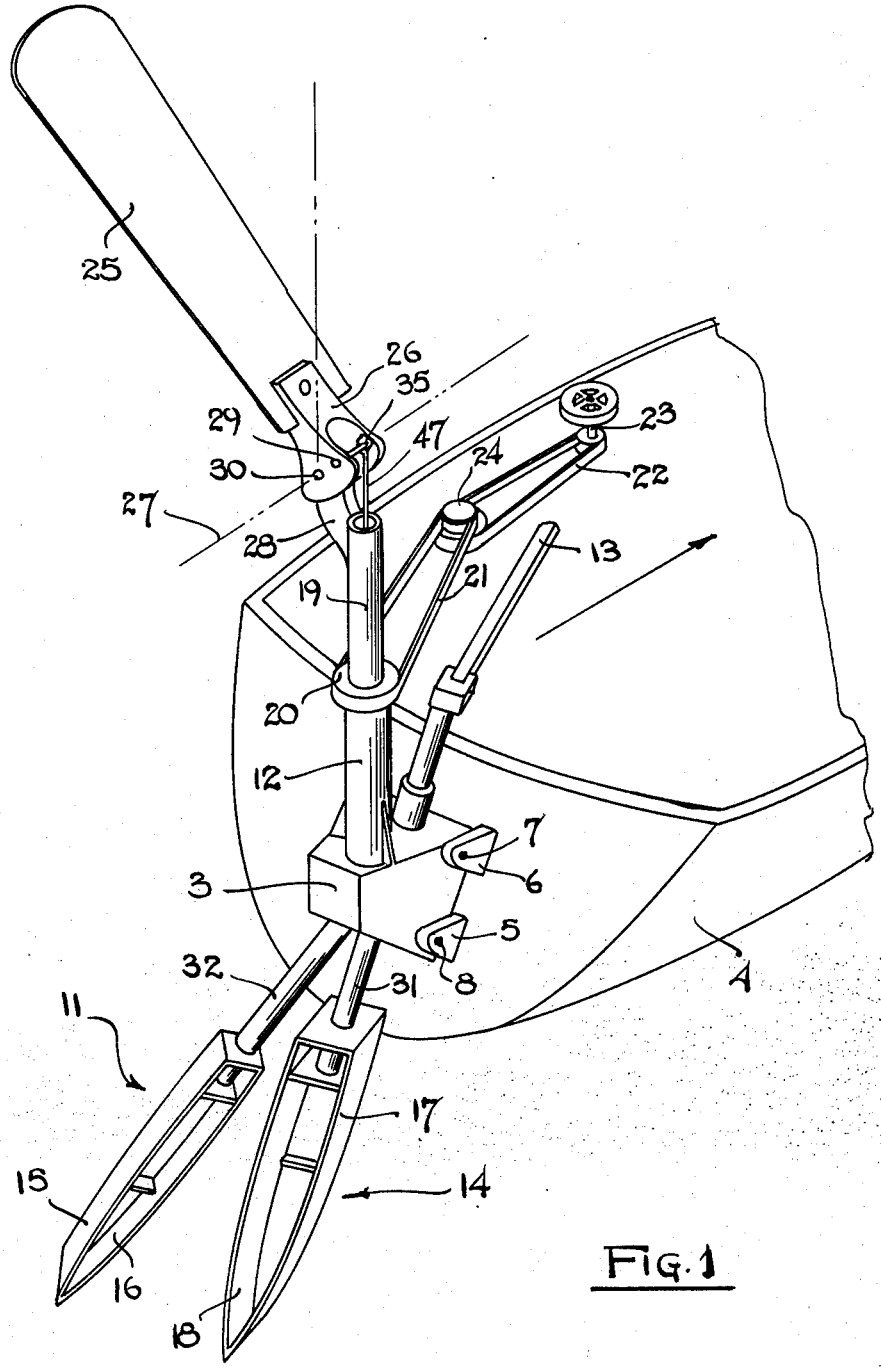
FIG. 1 is a perspective view illustrating a preferred embodiment of the invention installed on the transom of a sailboat

Referring now to FIG. 1, a perspective view of a preferred embodiment of the invention installed on a boat is shown. Support housing 3 is removably mounted on the transom of sailboat 4 by means of brackets 5 and 6 which are fixedly attached to the boat transom, and removable pin member 7 and 8, there being similar brackets and pin members (not shown) on the opposite side of the support housing. The shaft 31 of rudder member 14 is rotatably mounted in support housing 3, as to be described further on in the specification in connection with FIG. 3. A tiller 13 for manually steering the boat is connected to shaft 31, there being means, as to be described in connection with FIG. 6, for disconnecting shaft 31 from its linkage to shaft 32 when such fully manual operation is desired.

Wind vane 25 is mounted on support member 26. Support member 26 is mounted for rotation about axis 27 on bracket 28 by means of pin 30 which fits through oppositely positioned apertures in the bracket and support member arms. Push rod 47 is coupled by means of a ball joint 35 on pin 29 through support member 26, at an off-axis position thereon. Tubular member 19 is mounted for rotation in tube member 12 which is fixedly attached to housing 3. Fixedly attached to tubular member 19 is pulley wheel 20. Pulley wheel 20 is coupled by means of drive cables 21 and 22 and pulley wheel 24 to control wheel 23, which is used to set the desired course relative to apparent wind. Rudder member 14 is formed from a pair of metal sheets 17 and 18 which are joined together at their opposite ends in a bent V-shaped configuration and fixedly attached to shaft 31, the surfaces of these sheets forming hydrodynamic surfaces. Pendulum oar 11 is similarly constructed of a pair of non-corrosive metal sheets 15 and 16 forming hydrodynamic surfaces, which are fixedly attached at one end to shaft 32. This type of sheet metal construction provides a low cost, high strength member with a large overall surface area for any given longitudinal and lateral rudder dimension. Also, in very severe seas, the effect of side waves acting on these members will be less than if the same surface area were to be distributed over a single surface, thereby lessening the hazard of breakage.

The device operates as follows: With the boat heading set at a desired course relative to the apparent wind, wheel 23 is rotated to rotatably position vane 25 until the vane stands upright, indicating that the wind is blowing symmetrically along the sides of the vane, i.e., the side surfaces of the vane are aligned with the wind direction. If the boat should deviate from the desired heading relative to apparent wind, the vane will be subjected to a sidewise wind component, resulting in sidewise rotation or tilting thereof about axis 27. This will cause push rod 47 to be actuated, either upwardly or downwardly depending on the direction of sidewise motion of vane 25. As to be explained in connection with FIG. 3, push rod 47 is coupled to shaft 32 such that an upward or downward motion of the push rod result in a rotation of the shaft. This will result in a rotation of pendulum oar member 11 to give this oar member an angle of attack relative to the water stream whereby a sidewise force will be applied by the water to the oar member. This will result in pendulous (sidewise) motion of the oar member. This sidewise motion is coupled from shaft 32 through a linkage in housing 3 to shaft 31, to rotatably drive shaft 31 and rudder 14, as to be explained further on in the specification in connection with FIG. 3. Rudder 14 is rotated in a direction such as to cause the heading of the boat to change to bring the boat to the original desired heading relative to apparent wind (i.e., to eliminate the error). If used in conjunction with a main rudder, the effective projected lateral area of rudder 14 would typically be 25–40% of the main rudder lateral area.

For optimum stability, pendulum oar 11 is preferably dragged behind the moving boat at an angle of about 20°–35° relative to the horizontal plane of the boat. With such a tilted shaft, a pendulum motion will provide a stabilizing hydrodynamic "toe-in" effect for the pendulum oar. With such a tilt, the pendulum rotational motion will be hydrodynamically limited, even with substantial rotation of the shaft about its longitudinal axis (the input signal).

Figure 2:
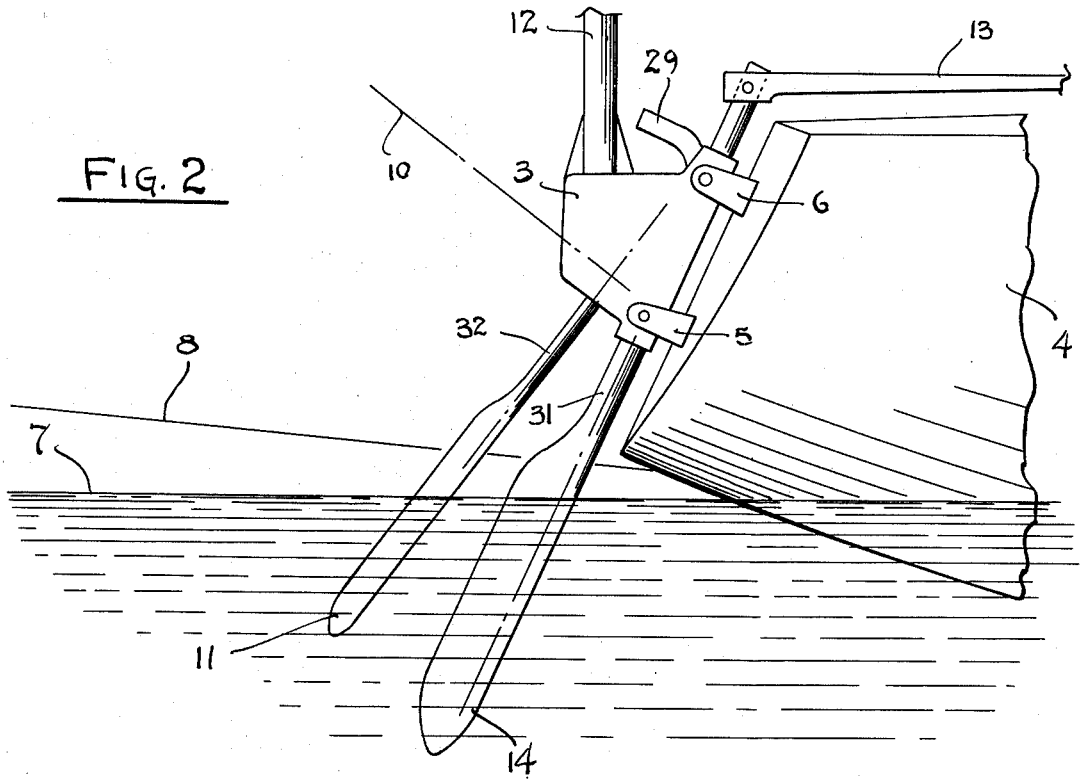
FIG. 2 is a perspective view of a second installation of the invention on the transom of a sailboat.

Referring now to FIG. 2, a variation of the embodiment of FIG. 1 is shown as installed on the transom of a boat. For convenience of illustration, the wind vane or other mechanism for providing a steering signal is not shown. A conventional type pendulum oar 11 and rudder 14 are utilized, the effective lateral area of pendulum oar 11 being about 20–25% of that of rudder 14. As in the embodiment of FIG. 1, pendulum oar 11 is supported in housing 10 for rotational motion about its longitudinal axis and pendulous motion about axis 10, while rudder 14 is supported in the housing for rotatable motion about its longitudinal axis. A high aspect ratio is preferred for both the pendulum oar and the rudder. A handle 29 is provided to facilitate installation and removal of the unit from its mounted position on brackets 5 and 6. Slots are provided in the upper bracket 6 to further facilitate these operations. The dynamic water line is indicated by the numeral 8 and the static water line by numeral 7.

Figure 3:
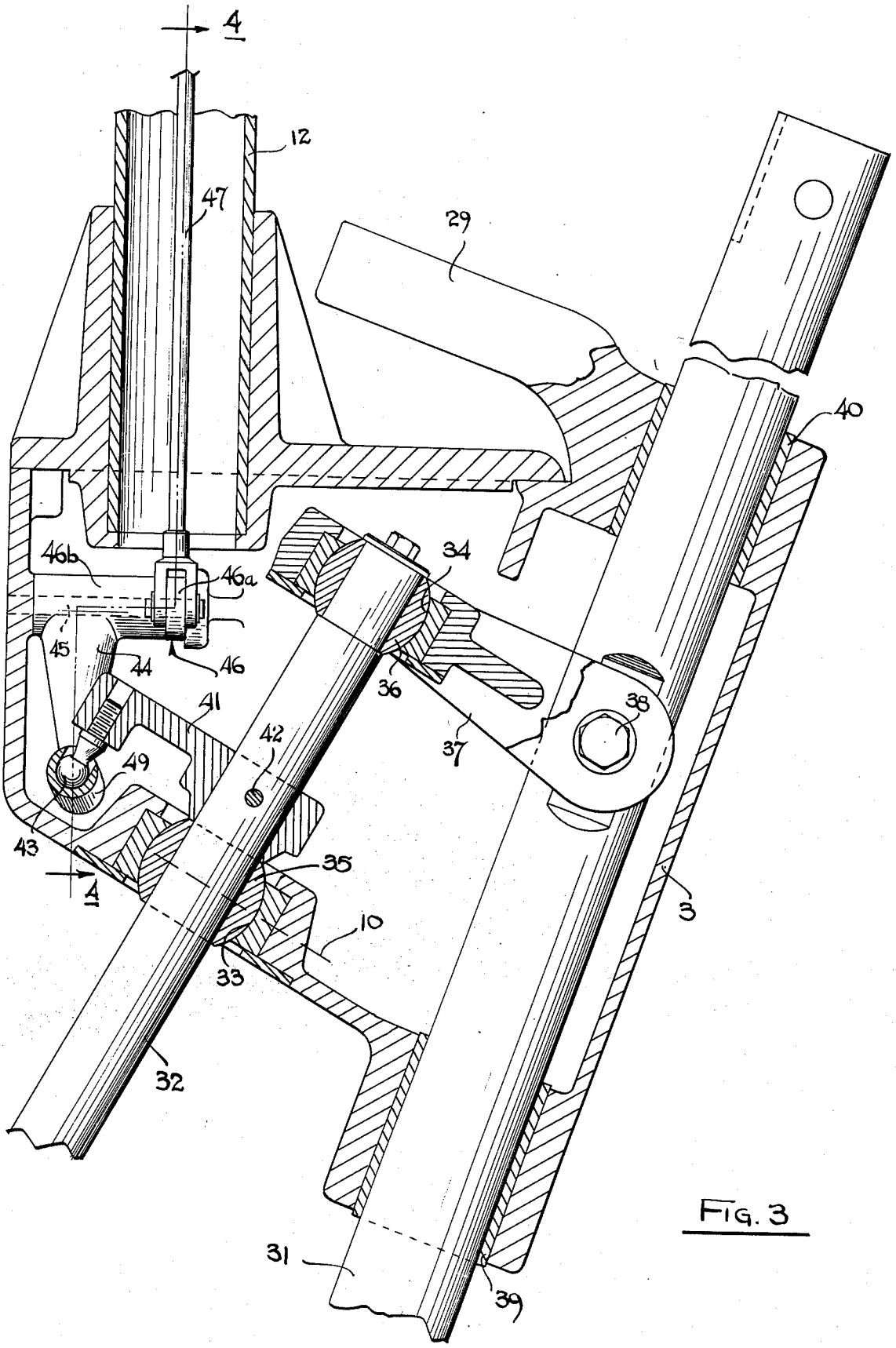
FIG. 3 is a cross sectional view illustrating the intercoupling between the members within the support housing in the preferred embodiment.
Figure 4:
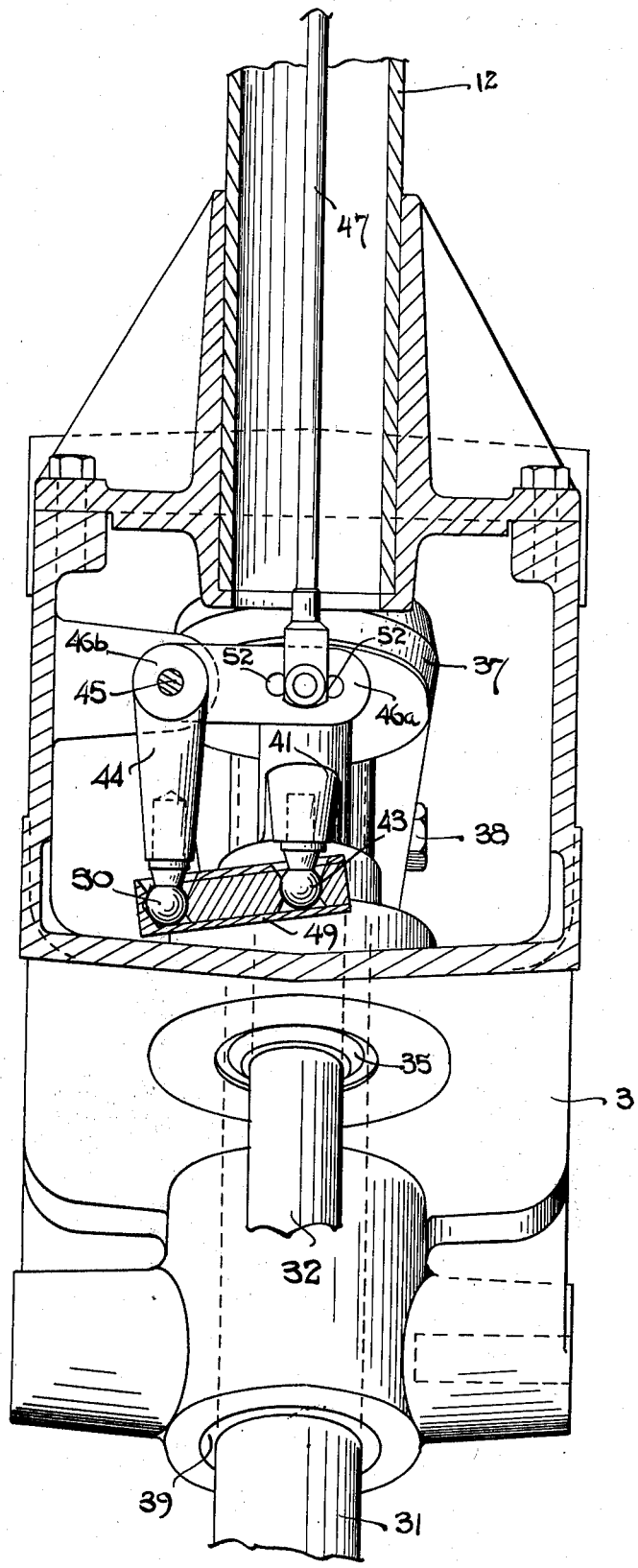
FIG. 4 is a cross sectional view taken along the plane indicated by 4—4 in FIG. 3.

Referring now to FIGS. 3 and 4, a preferred embodiment of the coupling mechanism located within housing 3 is illustrated. The rudder member shaft 31 is mounted in support housing 3 for rotation about its longitudinal axis by means of sleeve bearings 39 and 40. Push rod 47 enters the housing through tube member 12 which is fixedly attached to the housing. One end of push rod 47 is attached to rocker arm 46, rocker arm 46 having a plurality of apertures 52 formed therein to enable the selective positioning of the push rod along the arm. The rocker arm has a first portion 46*a* to which the push rod is attached, and a second portion 46*b* which extends perpendicularly from portion 46*a*, which is mounted for rotation on shaft 45 which extends from the wall of housing 3 to which it is fixedly attached. A second rocker arm 44 is fixedly attached to rocker arm portion 46*b*, and extends normally therefrom. Rocker arm 44 has a ball member 50 attached to one end thereof which forms a spherical joint with one end of ball joint linkage 49. Lever arm 41 has a ball member 43 attached to one end thereof which forms a spherical joint with the other end of ball joint linkage 49. Lever arm 41 is fixedly attached to shaft 32 by means of locking bolt 42. Spherical bearing member 35 is attached to shaft 32 and rides in concave spherical bearing 33 which is fixedly mounted on the wall of housing 3. Fixedly attached to the end of shaft 32 is spherical bearing member 36 which rides in a mating concave spherical bearing 34, which is mounted in linkage arm 37. Linkage arm 37 is linked to shaft 31 by means of locking bolt 38.

Operation is as follows: When push rod 47 is driven downwardly, rocker arm 46 is rotated on shaft 45. This causes rotation of rocker arm 44 (into the page in FIG. 3) which results in a clockwise rotation of shaft 32 (looking from above) and the oar attached thereto. This results in a pendulous motion of shaft 32 in response to the hydraulic force imparted to the pendulum oar, causing shaft 32 to rotate about axis 10 which results in a large torque being applied to shaft 31 through linkage unit 37 and bolt 38 to cause rotation of this shaft and actuation of the rudder attached thereto so as to effect steering of the boat to restore the heading to the desired course relative to apparent wind. It is to be noted that the pendulous motion of shaft 32 and the rotational motion of shaft 31 are mutually rigidly locked together. It is also to be noted that the spherical joint formed between ball member 43 and ball joint linkage 49 is here shown to be located slightly above the pendulum axis 10. This tends to contribute to further stability of operation and avoid oversteering by causing a decrease in the angle of attack of the oar when it pendulously swings out (feedback damping). A handle 29 is provided on the casing to facilitate the installation and removal of the device from the boat transom.

It is to be noted that the rudder turn angle for a given amount of pendulous motion of shaft 32 is a function of the distance between bearings 33 and 34, and the distance between bearing 34 and bolt 38. It is further to be noted that the pendulum axis 10 is not fixed relative to the housing as the pendulum angle is changed. This does not adversely affect the operation of the device. Push rod 47 is attached to rocker arm portion 46*a* in an appropriate one of apertures 52 which provides the proper calibration for the device, i.e., the proper vane fall angle in relation to the rotation of shaft 32. The pendulum axis 10 of the oar is tilted downwardly with respect to the horizontal plane of the boat in the direction towards the boat transom to improve the stability of operation by providing a "toe-in" effect for the oar.

Figure 6:
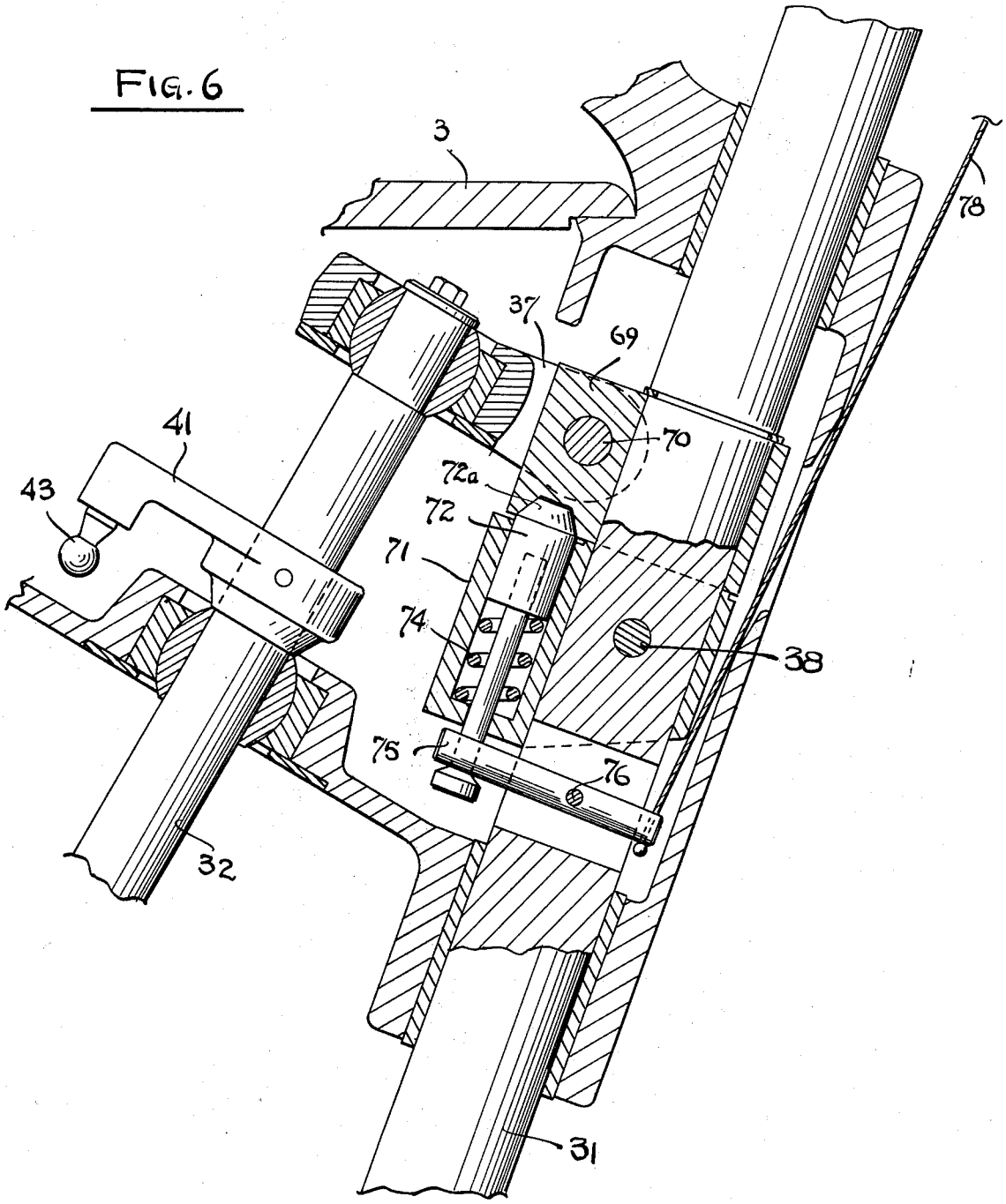
FIG. 6 is a cross sectional view illustrating a mechanism for disconnecting the linkage between the pendulum oar member and the rudder member.

Referring now to FIG. 6, a modified version of the preferred embodiment is illustrated, wherein means is provided to disconnect rudder shaft 31 from pendulum oar shaft 32, e.g., to permit easy manual steering and larger rotation of shaft 31. In this embodiment, linkage arm 37, rather than being bolted directly to shaft 31, is rather bolted by means of locking bolt 70 to sleeve member 69 which coaxially surrounds shaft 31 but is not attached thereto. Also coaxially surrounding shaft 31 is sleeve member 71, this sleeve member being locked to the shaft by means of locking bolt 38. Locking pin 72 has a conical head portion 72*a* which locks together sleeve 71 and sleeve 69 during automatic steering operation (as shown in FIG. 6), the locking pin being retained in the locked position by the action of spring 74. Locking pin 72 can be withdrawn from engagement with sleeve 69 by means of control cable 78, upward motion of this cable rotating lever arm 75 on pin 76, thereby moving locking pin 72 downwarldy against spring 74 and out of engagement with sleeve 69. The cable 78 may be retained by suitable means (not shown) so as to maintain the locking pin in the unlocked position. With the pin in such unlocked position, shaft 31 is free of the control action of the pendulum oar and may be rotated manually in response to a tiller or a helm control.

Figure 5:
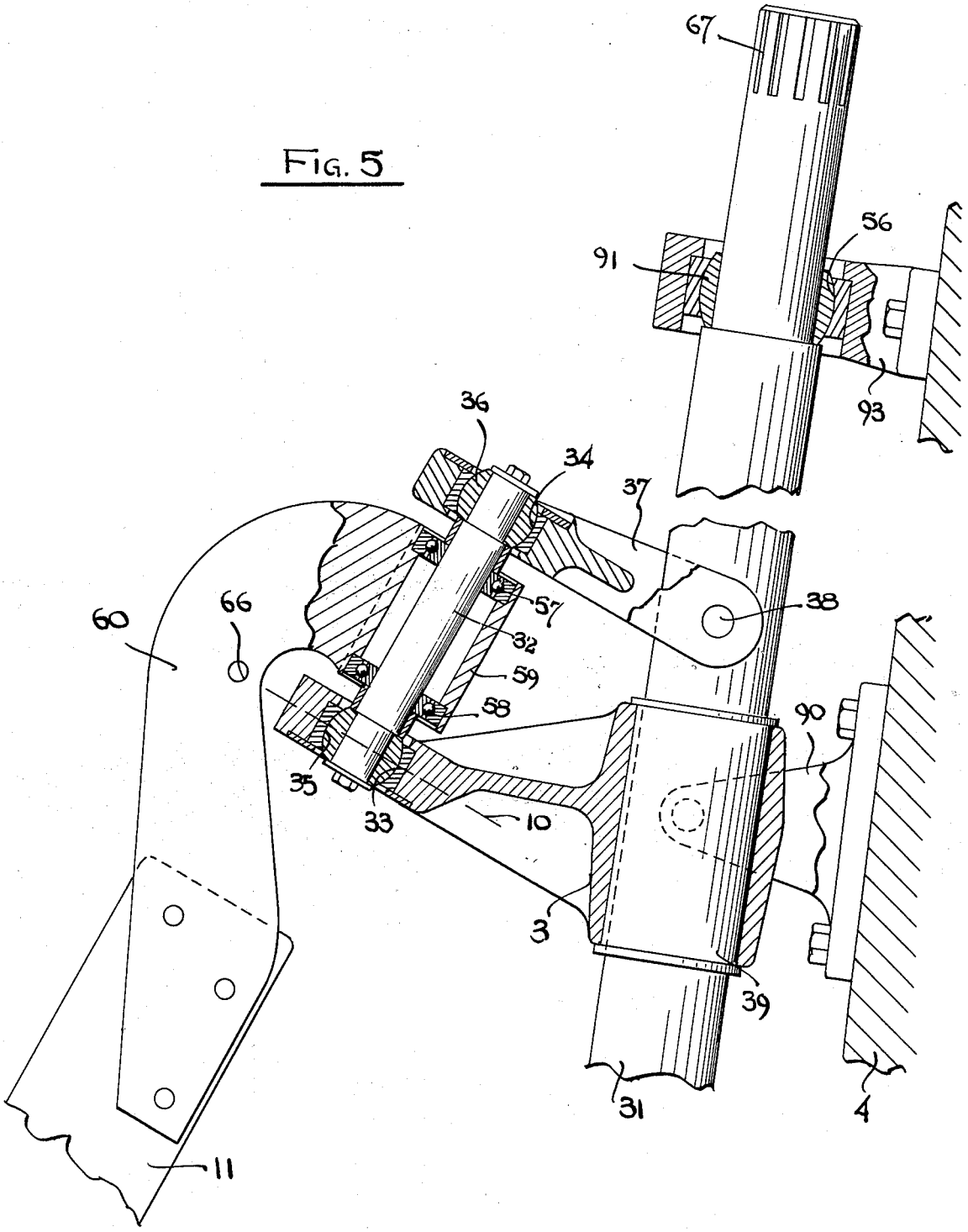
FIG. 5 is an alternative configuration for the pendulum oar member suspension.

Referring now to FIG. 5, another embodiment of the coupling mechanism between the rudder and pendulum oar is schematically shown. This configuration is for use with a split support structure. The pendulum oar 11 is attached to connecting arm 60 which couples the oar to cylindrical sleeve 59 which is fixedly attached to the arm. Sleeve 59 is rotatably mounted on shaft 32 by means of ball bearing assemblies 57 and 58. Thus connecting arm 60 and pendulum oar 11 can be rotated about the longitudinal axis of shaft 32. Such a rotational input signal is imparted to connecting arm 60 by a drive signal which may be applied at point 66 from a wind vane of the type described in connection with FIG. 3, or by some other steering control mechanism. Shaft 32 has a spherical bearing member 35 attached to one end thereof which rides on spherical bearing 33. Spherical bearing 33 is supported on the lower housing portion 3*a*. The other end of shaft 32 has a spherical member 36 attached thereto which rides in spherical bearing 34, this spherical bearing being connected to shaft 31 by means of linkage member 37. Linkage member 37 is bolted to the shaft 31 by means of locking bolt 38. Sleeve bearing 39, in which shaft 31 is rotatably supported, is mounted on the housing portion 3*a* which is attached to the transom of boat 4 by means of bracket 90. The upper portion of shaft 31 has a spherical member 91 attached thereto which preferably may ride in a spherical bearing 56, this last mentioned bearing being mounted on the boat hull by means of bracket 93. Splines 67 are provided at the end of shaft 31 for use in optionally attaching a tiller for manual steering to this shaft. This embodiment works in the same general manner as described for the previous embodiments. An input signal at point 66 rotates pendulum oar 11 which results in pendulous motion of the oar about axis 10 in response to the water pressure. This results in linkage unit 37 rotatably driving shaft 31 to cause the rudder to steer the boat such as to respond to the control signal input and, in the case of a wind vane control, to cancel out the error signal. It is to be noted that the pendulum axis 10 is tilted as in the previous embodiment, to provide a stabilizing "toe-in" effect for the pendulum oar.

Figure 7:
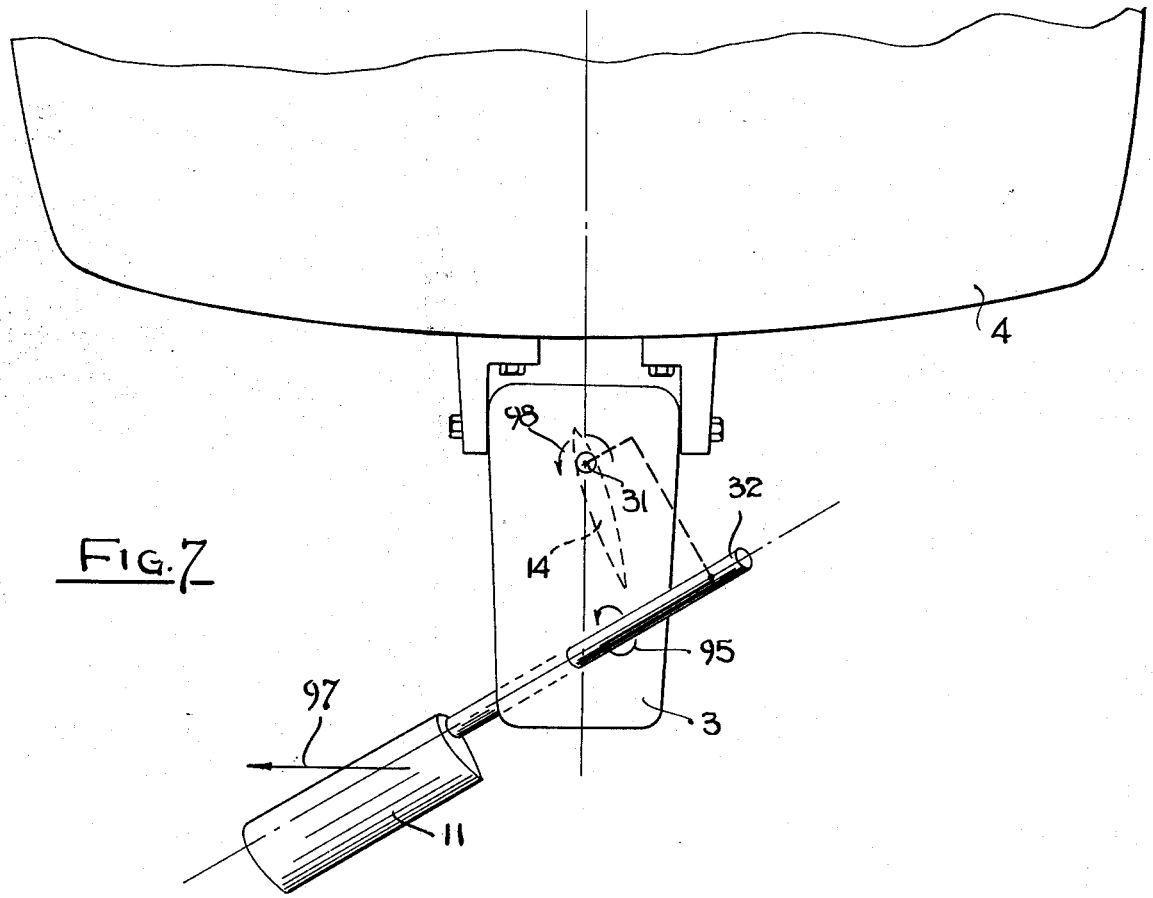
FIG. 7 is a schematic drawing illustrating the operation of the invention.

Referring now to FIG. 7, the operation of the device of the invention is schematically illustrated. FIG. 7 is a view taken looking straight down from above the transom of boat 4. In FIG. 7, it is assumed that shaft 32 has just been rotated from its neutral position in response to a wind vane signal as indicated by arrow 95. This causes oar member 11 to be turned relative to the water flow such that the component of the water force will drive the oar sidewise about its pendulum axis in the direction indicated by arrow 97. This results in a rotation of the rudder shaft 31 as indicated by arrow 98. The boat is thereby steered to a course to eliminate the error signal, shaft 32 being gradually rotated back to its original position by the wind vane signal as this error signal is reduced to zero. It is to be noted that pendulum oar 11 and rudder 14 initially operate cooperatively in the steering action, i.e., they are both turned in the same direction in response to the initial steering control signal.

Figure 8:
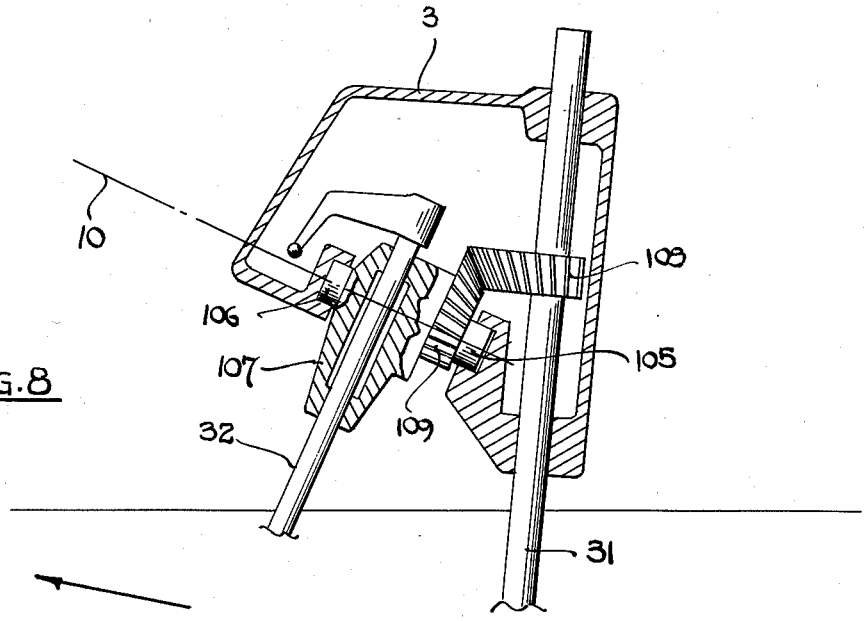
FIG. 8 is a cross sectional view of another embodiment of the coupling mechanism between the pendulum oar and rudder members.

Referring now to FIG. 8, another means for implementing the coupling between the pendulum oar and rudder shafts is schematically illustrated. Pendulum oar shaft 32 is mounted for rotation about its longitudinal axis in support member 107. Support member 107 is mounted for rotation about fixed pendulum axis 10 by means of trunions 105 and 106. Bevel gear 109 is fixedly attached to support member 107 while bevel gear 108 is fixedly attached to rudder shaft 31. Thus, as can be seen, when shaft 32 is pendulously driven in response to water force acting on the oar, shaft 31 will be rotatably driven on sleeve bearings 39 and 40 through gears 109 and 108.

Figure 9:
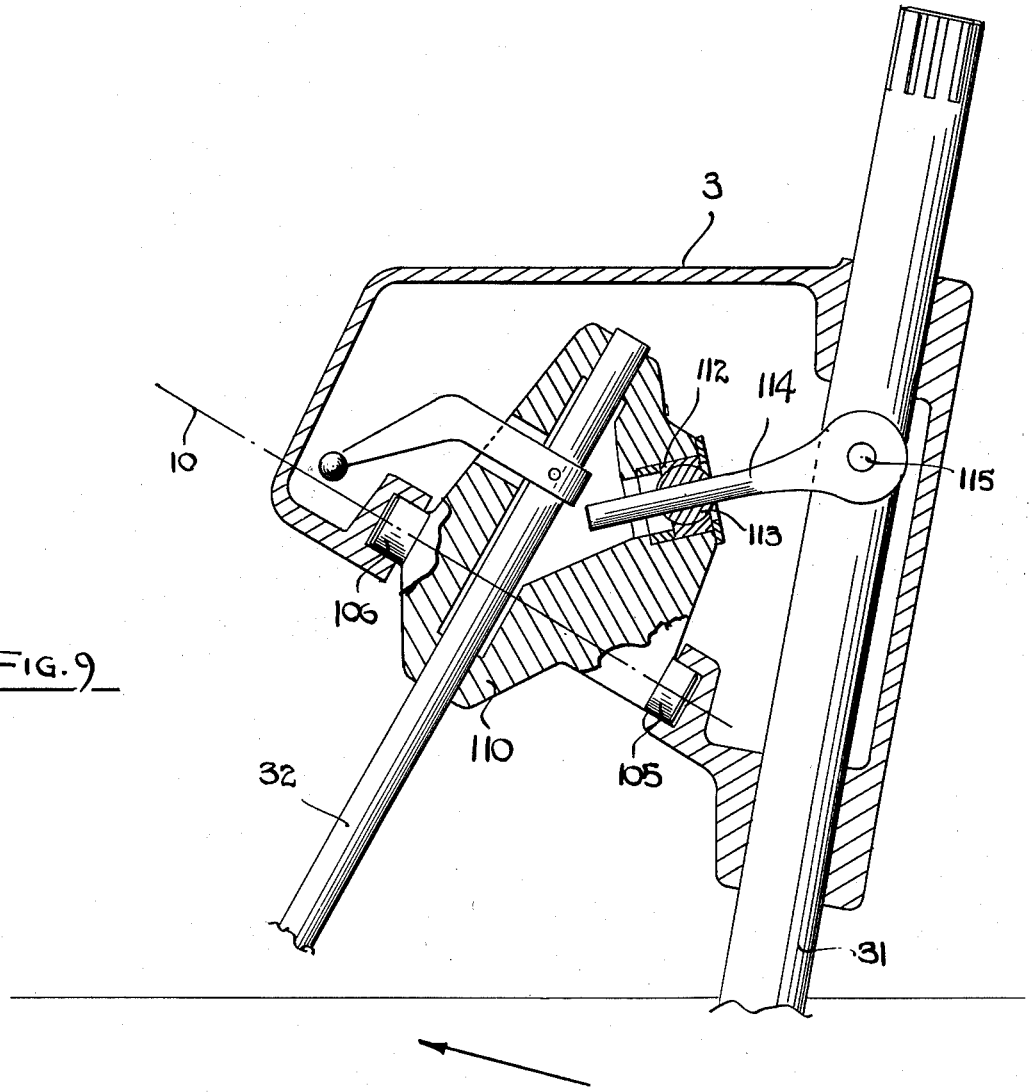
FIG. 9 is a cross sectional view of a further embodiment of the coupling mechanism.

Referring now to FIG. 9, another configuration for the coupling mechanism is schematically illustrated. In this mechanization, shaft 32 is rotatably supported for rotation about its longitudinal axis in cradle member 110. The cradle member is supported in housing 3 for rotational motion about axis 10 by means of trunnions 105 and 106. Cradle 110 is coupled to rudder shaft 31 by means of linkage member 114 which is slidably and rotatably supported on the cradle by means of spherical bearing 112 and ball member 113 in which the arm portion of the linkage is slidably supported. Spherical bearing 112 is adjustably mounted in the cradle so that the effective lever arm between the cradle and shaft 31 can be adjusted if so required. Thus, as for the previous embodiments, shaft 31 is rotated on sleeve bearings 39 and 40 in response to pendulous motion of shaft 32.

Referring now to FIG. 10, a further implementation of the coupling mechanism between the pendulum oar and rudder shaft is schematically illustrated. Pendulum oar shaft 32 is rotatably mounted for rotation about its longitudinal axis in cradle 120. Cradle 120 is supported for rotation about the pendulum axis 10 on housing structure 3 by means of trunnion 123 which extends from the cradle and fits within cylindrical sleeve 124 formed in the housing. Rudder shaft 31 is mounted in the housing on sleeve bearings 39 and 40 for rotation about its longitudinal axis. Linkage arm 128 is attached to shaft 31 by means of bolt 129. Cradle 120 is coupled to linkage 128 through universal joint 130 and shaft member 131, this shaft member being slidably supported in hollow linkage arm 128. As for the previous embodiments, it can be seen that pendulous motion of the pendulum oar shaft 32 about axis 10 will cause linkage 128 to impart rotational motion to shaft 31.

Referring now to FIG. 11, still a further embodiment of the coupling mechanism between the shafts is schematically illustrated. The pendulum oar shaft 32 is mounted for rotation about its longitudinal axis in cradle 135. In this instance, the pendulum oar shaft 32 and the rudder shaft 31 are both pointed in a direction such that both the pendulum oar and the rudder extend towards the boat hull, as compared with all of the previous embodiments where both of these members extend away from the boat hull. It is to be noted, however, that the pendulum axis 10 still tilts downwardly from the horizontal plane of the boat in the direction towards the transom but is not normal to the longitudinal rotation axis of the pendulum oar. As for the previous embodiments, rudder shaft 31 is rotatably supported on sleeve bearings 39 and 40 in housing 3. Shaft 32 is supported for rotation about its longitudinal axis in cradle 135, and for rotation about pendulum axis 10 by means of trunnion portion 123 which is rotatably supported in sleeve portion 124 of the housing. Cradle 135 is linked to shaft 31 in the same manner as in the embodiment of FIG. 9, i.e., by means of a slidable linkage 114 which is fixedly attached to shaft 31 by means of bolt 115. Linkage 114 has an arm portion which is slidably fitted through ball member 113, this ball member being supported on spherical bearing 112. As for the embodiment of FIG. 9, the position of spherical bearing 112 can be adjusted along cradle 135 to change the effective lever arm of the linkage. Thus, as for the previous embodiments, pivotal motion of shaft 32 about axis 10 provides a rotational motion of shaft 31.

The device of this invention thus provides a simple, relatively low cost boat steering device utilizing a hydrodynamic servo which can be installed as an integral unit on the transom of a boat.

While the invention has been described and illustrated in detail, it is to be clearly understood that this is intended by way of illustration and example only and is not to be taken by way of limitation, the spirit and scope of this invention being limited only by the terms of the following claims.

We claim:

1. A hydrodynamic servo device for steering a boat comprising:

support means mounted on the stern of the boat, an oar member having at least a pair of opposite sides forming hydrodynamic surfaces, means for suspending said oar member from said support means in the water stream behind the boat for rotational motion about a first axis thereby to change the angle of attack of the surfaces relative to the water stream, and for pendulous motion about a second axis generally transverse to said first axis, a rudder member having at least a pair of opposite sides forming hydrodynamic surfaces, bearing means on the support means for rotatably mounting said rudder member on said support means suspended in the water stream for rotational motion about a single axis thereby to change the angle of attack of the surfaces thereof relative to the water stream, means for coupling said oar member to said rudder member such that (as viewed from above facing the bow of the boat) pendulous motion of said oar member to the left causes counterclockwise rotational motion of the rudder member and pendulous motion of said oar member to the right causes clockwise rotational motion of the rudder member, pendulous motion of the oar member and rotational motion of the rudder member being mutually locked to each other, and means for providing a steering control signal to said oar member for rotating said oar member about said first axis to change the angle of attack thereof, whereby when the angle of attack of said oar member is changed from a neutral position, the oar member is pendulously driven and rotatably drives the rudder member to effect steering action.

2. The device of claim 1 wherein said means for suspending said oar member and said means for suspending said rudder member from the support means comprises first and second shafts respectively, first bearing means mounted on said support means for supporting the oar member shaft for motion about said first and second axes and second bearing means mounted on said support means for supporting said rudder member for rotational motion about said single axis.

3. The device of claim 2 wherein said means for coupling the oar member to the rudder member comprises a linkage arm fixedly attached at one end thereof to said rudder member shaft and attached at the other end thereof to said oar member shaft for at least two degrees of freedom, the fixed attachment of said linkage arm to the rudder member shaft limiting motion of the oar member to two degrees of freedom.

4. The device of claim 1 wherein said second axis, for pendulous motion of the oar member, is tilted downwardly with respect to the horizontal plane of the boat in the direction towards the boat transom.

5. The device of claim 1 wherein said means for providing a steering control signal comprises a wind vane mounted on said support means, said wind vane providing a motional signal in response to the wind whenever the side surfaces of the vane are not aligned with the wind direction and means for coupling said motional signal to said oar member to cause rotation thereof about said first axis.

6. The device of claim 5 wherein said motional signal is a linear motion and said means for coupling said signal to the oar member comprises a push rod coupled to the wind vane, first lever arm means for converting this linear motion to a rotational motion, a rocker arm fixedly attached to said first lever arm for motion therewith, a second lever arm fixedly attached to said oar member suspending means, and linkage means for linking said second lever arm to said rocker arm, said linkage means being joined to said rocker arm and said second lever arm by ball joints, the ball joint for said second lever arm being located above the second (pendulous motion) axis of the oar member.

7. The device of claim 1 wherein the first axis of said oar member is tilted with respect to a vector normal to the horizontal plane of the boat.

8. The device of claim 1 wherein the rudder and oar members each are formed from a pair of sheets joined together at opposite ends in a bent V-shaped configuration, said sheets being spaced apart from each other between the opposite ends thereof.

9. The device of claim 2 wherein said first bearing means comprises a first spherical bearing for supporting said oar member shaft on said support means for three degrees of freedom and a second spherical bearing positioned on said shaft above said first bearing for connecting said shaft to said coupling means.

10. The device of claim 1 wherein said means for suspending the oar member from the support means comprises a shaft, a spherical bearing for supporting said shaft on said support means for three degrees of freedom, a linkage arm fixedly connected to the rudder member, a spherical bearing for coupling the linkage arm to said shaft and an arm for interconnecting the oar member and said shaft, said arm being rotatably connected to said shaft and fixedly attached to said oar member.

11. The device of claim 2 and further comprising means for selectively disabling the means for coupling the oar member to the rudder member.

12. The device of claim 11 wherein said coupling means comprises a linkage arm attached at one end thereof to the oar member shaft for at least two degrees of freedom, and a locking pin slidably supported on said rudder shaft for selectively locking the other end of said linkage arm thereto and means for slidably actuating said locking pin to unlock the linkage arm from the rudder shaft to permit rotation of the rudder shaft independently of the oar member shaft.

13. The device of claim 2 wherein said first bearing means comprises a cradle member, a first bearing device for supporting the oar member on the cradle member for rotation about the first axis and a second bearing device for supporting the cradle member on the support means for rotation about the second axis.

14. The device of claim 13 wherein the second bearing device comprises a pair of trunnions extending from the cradle member.

15. The device of claim 13 wherein the second bearing device comprises a single trunnion extending from the cradle member.

16. The device of claim 13 wherein the means for coupling the oar member to the rudder member comprises first and second interconnected bevel gears attached to the cradle member and the rudder member shaft respectively.

17. The device of claim 13 wherein the means for coupling the oar member to the rudder member comprises a linkage arm fixedly attached at one end to the rudder member shaft and means for connecting said arm to the cradle member for slidable motion and rotatable motion about two axes.

18. The device of claim 17 wherein the means for connecting the arm to the cradle member comprises a spherical bearing mounted on the cradle member for at least two degrees of freedom, said arm being slidably connected to said bearing.

19. The device of claim 17 wherein the means for connecting the arm to the cradle member comprises a shaft slidably connected to the arm and a universal joint connecting said last mentioned shaft to the cradle member.

20. A hydrodynamic servo device for steering a boat comprising support means mounted on the stern of the boat, an oar member having at least a pair of opposite sides forming hydrodynamic surfaces, means for suspending said oar member from said support means in the water stream behind the boat for rotational motion about a first axis thereby to change the angle of attack of the surfaces relative to the water stream, and for pendulous motion about a second axis generally transverse to said first axis, comprising a shaft fixedly attached to said oar member and a spherical bearing for supporting said shaft on said support means for three degrees of freedom, a rudder member having at least a pair of opposite sides forming hydrodynamic surfaces, means for suspending said rudder member from said support means in the water stream for rotational motion about a single axis thereby to change the angle of attack of the surfaces thereof relative to the water stream, comprising a shaft fixedly attached to the rudder member and bearing means for rotatably supporting said shaft on said support means, means for coupling said oar member to said rudder member such that pendulous motion of said oar member causes rotational motion of the rudder member, pendulous motion of the oar member and rotational motion of the rudder member being mutually locked to each other, said coupling means comprising a linkage arm, a spherical bearing connecting said linkage arm to the oar member shaft for three degrees of freedom and means for fixedly connecting the linkage arm to the rudder shaft thereby limiting motion of the rudder member to two degrees of freedom, and means for providing a steering control signal to said oar member for rotating said oar member about said first axis to change the angle of attack thereof, whereby when the angle of attack of said oar member is changed from a neutral position, the oar member is pendulously driven and rotatably drives the rudder member to effect steering action.

21. The device of claim 20 wherein said second axis, for pendulous motion of the oar member, is tilted downwardly with respect to the horizontal plane of the boat in the direction towards the boat transom.

22. The device of claim 20 wherein said means for providing a steering control signal comprises a wind vane mounted on said support means, said wind vane providing a motional signal in response to the wind whenever the side surfaces of the vane are not aligned with the wind direction and means for coupling said motional signal to said oar member to cause rotation thereof about said first axis.

23. The device of claim 22 wherein said motional signal is a linear motion and said means for coupling said signal to the oar member comprises a push rod coupled to the wind vane, a first lever arm means for converting this linear motion to a rotational motion, a rocker arm fixedly attached to said first lever arm for motion therewith, a second lever arm fixedly attached to said oar member shaft, and linkage means for linking said second lever arm to said rocker arm, said linkage means being joined to said rocker arm and said second lever arm by ball joints, the ball joint for said second lever arm being located above the pendulous motion axis of the oar member.

24. The device of claim 20 wherein said oar member is tilted with respect to the horizontal plane of the boat.

25. The device of claim 20 wherein the rudder and oar members each are formed from a pair of sheets joined together at opposite ends in a bent V-shaped configuration, said sheets being spaced apart from each other between the opposite ends thereof.

26. The device of claim 20 and further comprising means for selectively disabling the means for coupling the oar member to the rudder member.

27. The device of claim 26 wherein said disabling means comprises a locking pin slidably supported on said rudder shaft for selectively connecting said linkage arm thereto and means for slidably actuating said locking pin to unlock the linkage arm from the rudder shaft to permit rotation of the rudder shaft independently of the oar member shaft.

28. The device of claim 1 wherein the rudder member is formed from a pair of opposing members joined together and spaced apart from each other between the opposite ends thereof.

29. The device of claim 1 wherein the oar member is formed from a pair of opposing members joined together and spaced apart from each other between the opposite ends thereof.

* * * * *